US012691545B2

(12) United States Patent
Akahori

(10) Patent No.: US 12,691,545 B2
(45) Date of Patent: Jul. 28, 2026

(54) PROCESSING SYSTEM

(71) Applicant: TOKYO SEIMITSU CO., LTD., Hachioji (JP)

(72) Inventor: Hajime Akahori, Hachioji (JP)

(73) Assignee: TOKYO SEIMITSU CO. , LTD., Tokyo (JP)

( * ) Notice: Subject to any disclaimer, the term of this patent is extended or adjusted under 35 U.S.C. 154(b) by 403 days.

(21) Appl. No.: 18/282,534

(22) PCT Filed: Dec. 7, 2021

(86) PCT No.: PCT/JP2021/044821
§ 371 (c)(1),
(2) Date: Sep. 17, 2023

(87) PCT Pub. No.: WO2022/201650
PCT Pub. Date: Sep. 29, 2022

(65) Prior Publication Data

US 2024/0181589 A1 Jun. 6, 2024

(30) Foreign Application Priority Data

Mar. 26, 2021 (JP) ..... 2021-052535

(51) Int. Cl.
*B24B 7/02* (2006.01)
*B24B 51/00* (2006.01)

(52) U.S. Cl.
CPC ..... *B24B 7/02* (2013.01); *B24B 51/00* (2013.01)

(58) Field of Classification Search
CPC ..... B24B 7/228; B24B 49/02; B24B 49/04; B24B 49/12; B24B 37/30; B24B 37/013; B24B 37/042; B24B 37/005
See application file for complete search history.

(56) References Cited

U.S. PATENT DOCUMENTS 5,816,895 A * 10/1998 Honda ..... B24B 7/16 451/6
6,656,818 B1 * 12/2003 Kishimoto ..... H01L 21/02013 438/692

(Continued)

FOREIGN PATENT DOCUMENTS

JP 2009117648 5/2009
JP 2013212571 10/2013

(Continued)

OTHER PUBLICATIONS

Office Action in counterpart Chinese application No. 202180096326.7, Issue Date Jul. 29, 2025; with English translation; 11 pages.

(Continued)

*Primary Examiner* — Joel D Crandall
(74) *Attorney, Agent, or Firm* — Fattibene and Fattibene, LLC; Paul A. Fattibene

(57) ABSTRACT

A processing system capable of processing a workpiece with high accuracy. A tilting device capable of tilting a rotation axis 3*a* of a chuck 3 holds a workpiece W. A film thickness measurement device 7 measures a film thickness of the workpiece W after fine grinding in a non-contact manner. A control device 8 operates a shape of the workpiece W after fine grinding on the basis of a measurement value of the film thickness measurement device 7, calculates a tilt angle of the tilting device such that a difference between a maximum thickness and a minimum thickness of the workpiece W after the fine grinding decreases, and tilts the chuck 3 by the tilt angle such that the workpiece W after the fine grinding is reprocessed by rough grinding, intermediate grinding, and fine grinding in this order with the chuck 3 tilted by the tilt angle.

2 Claims, 5 Drawing Sheets

(56) References Cited

U.S. PATENT DOCUMENTS

| | | | | |
|---|---|---|---|---|
| 2002/0081954 | A1* | 6/2002 | Mori | B24B 7/228 451/65 |
| 2009/0186562 | A1* | 7/2009 | Kajiyama | B24B 37/042 451/57 |
| 2011/0294233 | A1* | 12/2011 | Nakata | H01L 22/20 257/E21.53 |
| 2017/0095902 | A1* | 4/2017 | Yoshida | B24B 7/228 |
| 2020/0180105 | A1* | 6/2020 | Inoue | B24B 51/00 |
| 2020/0316750 | A1* | 10/2020 | Matsubara | B24B 49/02 |

FOREIGN PATENT DOCUMENTS

| | | |
|---|---|---|
| JP | 2016201422 | 12/2016 |
| JP | 2019093517 | 6/2019 |
| KR | 20200070103 | 6/2020 |

OTHER PUBLICATIONS

International Preliminary Report on Patentability, PCT/JP2021/044821 dated Jul. 20, 2022, 3 pages.

Office Action in counterpart Korean application No. 10-2023-7031765, Dispatch Date Sep. 28, 2024; with English translation; 10 pages.

International Search Report, PCT/JP2021/044821, dated Jan. 18, 2022, 2 pages.

* cited by examiner

[ Figure 1]
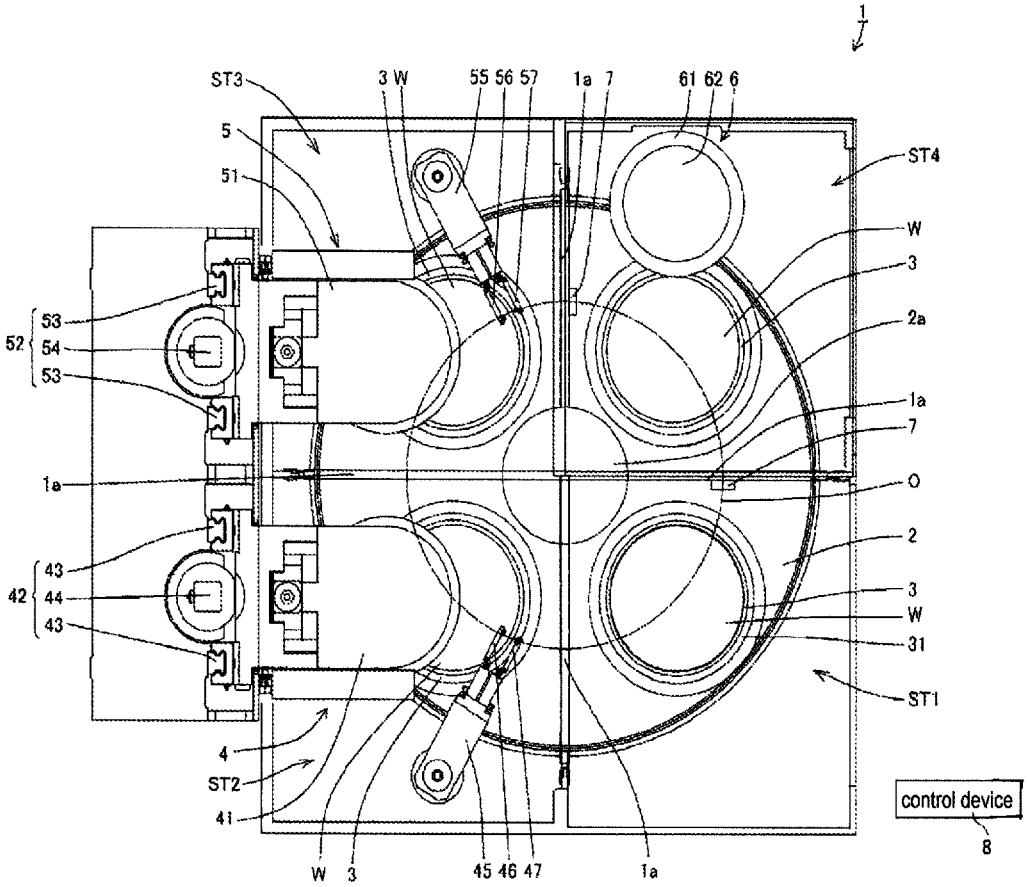

[Figure 2]
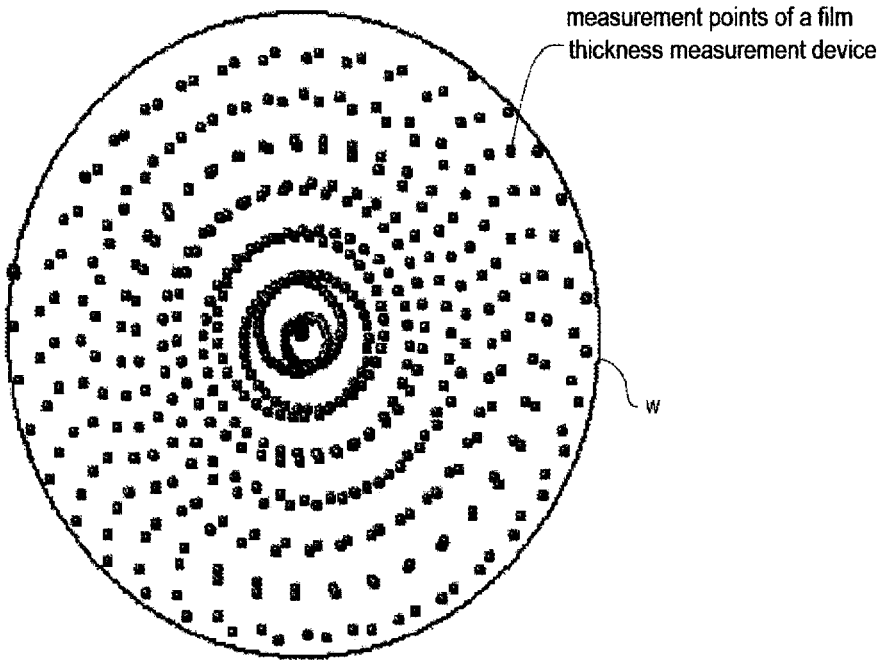

[Figure 3]
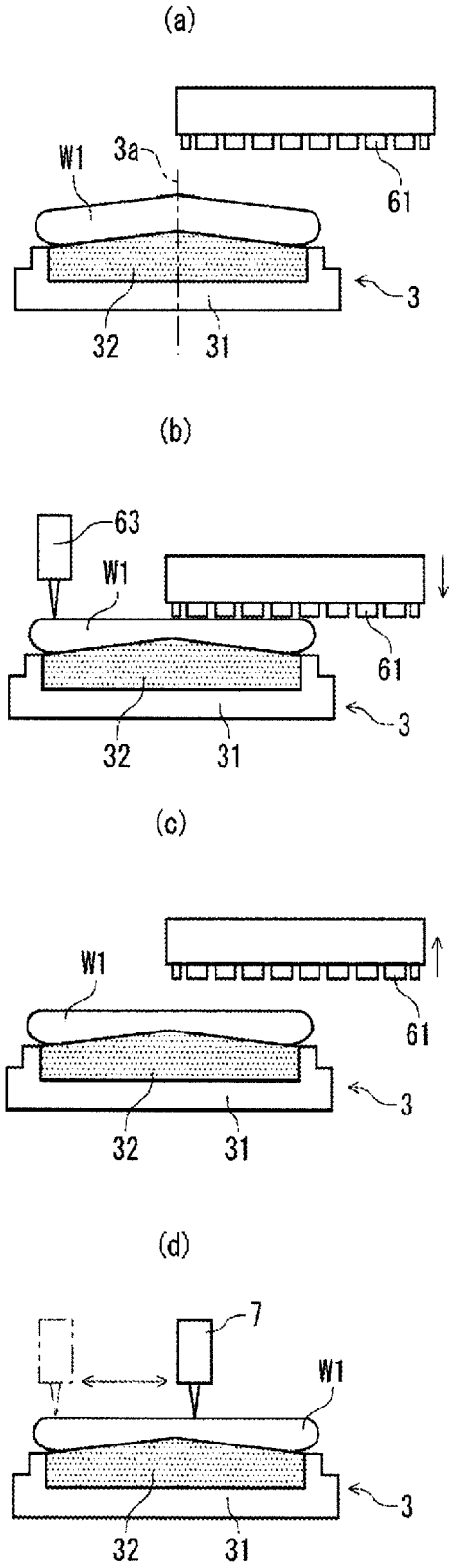

PROCESSING SYSTEM

TECHNICAL FIELD

The present invention relates to a processing system that processes a workpiece to be thin.

BACKGROUND ART

In a semiconductor manufacturing field, a grinding device that presses a grinding surface of a grinding stone that rotates against a workpiece and grinds the workpiece has been known as one that grinds a semiconductor wafer such as a silicon wafer (hereinafter referred to as a "workpiece") to be thin and flat.

Patent Literature 1 discloses an apparatus that processes a workpiece by rough grinding processing and fine grinding processing in this order, cleans a protective tape and a rear surface of the workpiece, and then measures a thickness of the workpiece using a electrostatic capacitance sensor.

CITATION LIST

Patent Literature

Patent Literature 1: Japanese Patent Laid-Open No. 2009-117648

SUMMARY OF INVENTION

Technical Problem

There is a case where to process a workpiece with high accuracy, fine grinding for the workpiece is temporarily stopped to measure a thickness of the workpiece and the fine grinding is performed again for the same workpiece on the basis of a measurement result. However, a grinding stone has been recently fine-grained. If the fine grinding is resumed after the thickness measurement, the grinding stone is insufficiently dressed so that the sharpness of the grinding stone deteriorates. Accordingly, a shape of the workpiece after the regrinding may be unstable or a surface of the workpiece may be burned.

Therefore, there occurs a technical problem to be solved to process a workpiece with high accuracy, and the present invention has its object to solve this problem.

Solution to Problem

To attain the above-described object, a processing system according to the present invention is a processing system that processes a workpiece by pre-grinding and fine grinding in this order, the processing system including a tilting device capable of tilting a rotation axis of a chuck that holds the workpiece, a measurement device that measures a film thickness of the workpiece after fine grinding in a non-contact manner, and a control device that calculates or determines a shape of the workpiece after the fine grinding on the basis of a measurement value of the measurement device, calculates a tilt angle of the tilting device such that a difference between a maximum thickness and a minimum thickness of the workpiece after the fine grinding decreases, and tilts the chuck by the tilt angle, in which the workpiece after the fine grinding is reprocessed by pre-grinding and fine grinding in this order with the chuck tilted by the tilt angle.

According to this configuration, the measurement device measures a film thickness of the workpiece that has been subjected to processing in a first stage, and the control device calculates the tilt angle of the rotation axis of the chuck capable of processing the workpiece after the processing in the first stage to be substantially flat from a shape of the workpiece, and performs pre-grinding and fine grinding again for the workpiece with the rotation axis of the chuck tilted by the tilt angle. Accordingly, even when a fine grinding stone is fine, a fine grinding stone is dressed by the pre-grinding so that the sharpness of the grinding stone is maintained, thereby making it possible to process the workpiece efficiency and with high accuracy.

Advantageous Effect of Invention

The present invention makes it possible to process a workpiece with high accuracy.

BRIEF DESCRIPTION OF DRAWINGS

FIG. 1 is a plan view illustrating a processing system according to an embodiment of the present invention.

FIG. 2 is a schematic view illustrating a positional relationship among measurement points of a measurement device on a workpiece.

FIG. 3 is a schematic view FIGS. 3*a-d* are schematic views illustrating how the workpiece is subjected to processing in a first stage.

FIG. 4 is a schematic view

FIG. 5 is a schematic view

DESCRIPTION OF EMBODIMENT

Figure 4A:
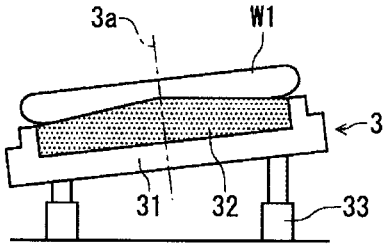
FIGS. 4*a-d* are schematic views illustrating how the workpiece is subjected to processing in a second stage.

An embodiment of the present invention will be described with reference to the drawings. Hereinafter, when reference is made to the number of components or a numerical value, amount, range, or the like of each of the components, the number or the like is not limited to a particular number but may be the particular number or more or the particular number or less unless otherwise stated or except when expressly limited to the particular number in principle.

When reference to a shape of each of components and a positional relationship among the components, a substantially approximate or similar shape or the like is included unless otherwise stated or except when considered to be expressly excluded in principle.

In the drawings, there is a case where characteristic portions are exaggerated by being enlarged, for example, in order to facilitate the understanding of features, and a dimension ratio or the like of each of the components is not necessarily the same as an actual one. In a cross-sectional view, hatching of some of the components may be omitted in order to facilitate the understanding of a cross-sectional structure of the components.

FIG. 1 is a plan view illustrating a basic configuration of a processing system 1. The processing system 1 continuously performs a plurality of grinding processes for a workpiece W. The processing system 1 may perform either one of grinding processing and polishing processing.

The processing system 1 is provided with four stages, i.e., a platform stage ST1, a rough grinding stage ST2, an intermediate grinding stage ST3, and a fine grinding stage ST4. The number of stages (pre-grinding stages) for sequentially processing the workpiece W on the upstream side of the fine grinding stage ST4 is not limited to two (the rough grinding stage ST2 and the intermediate grinding stage ST3), but may be one or three or more.

The processing system 1 includes an index table 2 that is rotatable in a clockwise direction on the plane of FIG. 1 and four chucks 3 arranged to be equally spaced apart from one another on a concentric circle around a rotation axis 2*a* of the index table 2. When the index table 2 rotates step by step by 90 degrees, the chuck 3 is movable to the platform stage ST1, the rough grinding stage ST2, the intermediate grinding stage ST3, and the fine grinding stage ST4 in this order.

A suction member 32, described below, composed of a porous material such as alumina is embedded in an upper surface of a rotation table 31. The chuck 3 includes a duct not illustrated extending to its surface through its inner portion. The duct is connected to a vacuum source, a compressed air source, or a water supply source via a rotary joint not illustrated. When the vacuum source is started, the workpiece W placed on the chuck 3 is suction-held in the chuck 3. When the compressed air source or the water supply source is started, suction between the workpiece W and the chuck 3 is released.

The rotation table 31 is connected to a chuck spindle not illustrated. The chuck spindle is configured to be able to be driven to rotate around a rotation axis perpendicular to the rotation table 31. The chuck 3 may include a tilting mechanism 33 having a known configuration capable of tilting the rotation table 31.

In the platform stage ST1, the workpiece W before grinding is conveyed onto the chuck 3 by a conveyance arm not illustrated. The workpiece W is previously subjected to positioning for causing its direction to match a predetermined direction. The workpiece W after the grinding is conveyed to a cleaning device not illustrated from the chuck 3 by the conveyance arm.

The rough grinding stage ST2 is provided with a rough grinding device 4. The rough grinding device 4 includes a rough grinding stone not illustrated, a first spindle 41 that has the rough grinding stone attached to its lower end and rotatably supports the rough grinding stone, and a first spindle feeding mechanism 42 that raises and lowers the first spindle 41 in a vertical direction.

A cup-shaped grinding stone #8000, for example, is used as the rough grinding stone. The first spindle feeding mechanism 42 includes two linear guides 43 that guide a movement direction of the first spindle 41 and a ball screw slider mechanism 44 that raises and lowers the first spindle 41.

The rough grinding device 4 is provided with a first contact-type thickness measurement device 45. The first contact-type thickness measurement device 45 includes a pair of detection arms 46 and 47 each having a contact provided at its distal end.

During rough grinding processing, the contact of the detection arm 46 contacts an upper surface of the workpiece W and the contact of the detection arm 47 contacts an upper surface of the chuck 3, thereby making it possible to measure a thickness of the workpiece W from a difference between heights respectively detected by the contacts of the detection arms 46 and 47. The thickness of the workpiece W measured by the first contact-type thickness measurement device 45 includes a thickness of a device formed on one surface of the workpiece W, a protective tape affixed to the one surface, or the like.

The intermediate grinding stage ST3 is provided with an intermediate grinding device 5. The intermediate grinding device 5 includes an intermediate grinding stone not illustrated, a second spindle 51 that has the intermediate grinding stone attached to its lower end and rotatably supports the intermediate grinding stone, and a second spindle feeding mechanism 52 that raises and lowers the second spindle 51 in a vertical direction.

A cup-shaped grinding stone #8000, for example, is used as the intermediate grinding stone. The second spindle feeding mechanism 52 includes two linear guides 53 that guide a movement direction of the second spindle 51 and a ball screw slider mechanism 54 that raises and lowers the second spindle 51.

The intermediate grinding device 5 is provided with a second contact-type thickness measurement device 55. The second contact-type thickness measurement device 55 includes a pair of detection arms 56 and 57 each having a contact provided at its distal end.

During intermediate grinding processing, the contact of the detection arm 56 contacts the upper surface of the workpiece W and the contact of the detection arm 57 contacts the upper surface of the chuck 3, thereby making it possible to measure a thickness of the workpiece W from a difference between heights respectively detected by the contacts of the detection arms 56 and 57. The thickness of the workpiece W measured by the second contact-type thickness measurement device 55 includes a thickness of a device formed on one surface of the workpiece W, a protective tape affixed to a rear surface of the workpiece W, or the like.

The fine grinding stage ST4 is provided with a fine grinding device 6. The fine grinding device 6 includes a fine grinding stone 61, a third spindle 62 that has the fine grinding stone 61 attached to its lower end and rotatably supports the fine grinding stone 61, and a third spindle feeding mechanism not illustrated that raises and lowers the third spindle 62 in a vertical direction.

An example of the fine grinding stone 61 is a cup-shaped grinding stone #8000. The grinding stone stage ST4 is provided with a non-contact-type thickness measurement device 63, described below. The non-contact-type thickness measurement device 63 measures a thickness (film thickness) of the workpiece W during fine grinding.

The processing system 1 is provided with a film thickness measurement device 7. The film thickness measurement device 7 measures a thickness (film thickness) of the workpiece W in a non-contact manner. The film thickness of the workpiece W measured by the film thickness measurement device 7 does not include a thickness of a device formed on one surface of the workpiece W, a protective tape affixed to the one surface, or the like. An example of the film thickness measurement device 7 is spectral interference-type film thickness measurement equipment.

The film thickness measurement device 7 is fixed to a frame 1*a* constructed in the processing system 1, and is installed above the index table 2. A measurement point at which the film thickness measurement device 7 measures a film thickness of the workpiece W is set on a rotational trajectory O of a center axis of the chuck 3 as viewed from the top.

FIG. 2 is a schematic view illustrating a positional relationship among measurement points of the film thickness measurement device 7 on the workpiece W. FIG. 2 illustrates a positional relationship among the measurement points of the film thickness measurement device 7 in a case where the number of revolutions of the index table 2 is set to 20 deg/s, the number of revolutions of the chuck 3 is set to 400 rpm, and the sampling period of the film thickness measurement device 7 is set to 4 msec. The workpiece W passes immediately below the film thickness measurement device 7 while rotating. Accordingly, a track of the measurement points of the film thickness measurement device 7 spreads over the entire surface of the workpiece W including the center of the workpiece W. The track of the measurement points of the film thickness measurement device 7 is appropriately changeable depending on the number of revolutions of the index table 2, the number of revolutions of the chuck 3, and the sampling period of the film thickness measurement device 7.

One film thickness measurement device 7 and one film thickness measurement device 7 are respectively provided on the upstream side and the downstream side of the fine grinding stage ST4 in a rotational direction of the index table 2. When the workpiece W after processing is transferred to the platform stage ST1 from the fine grinding stage ST4, the index table 2 may rotate in a clockwise direction or may rotate in a counterclockwise direction on the plane of FIG. 1 in relation to a rotation mechanism of the index table 2. In order to correspond to each rotational direction of the index table 2, the one film thickness measurement device 7 and the one film thickness measurement device 7 are respectively provided on the upstream side and the downstream side of the fine grinding stage ST4.

An operation of the processing system 1 is controlled by a control device 8. The control device 8 controls each of components constituting the processing system 1. The control device 8 includes a CPU and a memory, for example. A function of the control device 8 may be implemented by control using software or may be implemented by operating using hardware.

Then, a procedure for sequentially processing the two workpieces W by the same chuck will be described. The two workpieces W are assigned reference numerals W1 and W2 when distinguished.

First Workpiece (Processing in First Stage)

In the platform stage ST1, the workpiece W1 is placed on the chuck 3. When the vacuum source is started, a negative pressure is supplied between the workpiece W1 and the chuck 3, whereby the workpiece W1 is suction-held in the chuck 3.

Then, the index table 2 rotates, and the chuck 3 moves toward the rough grinding stage ST2.

The chuck 3 moves to the rough grinding stage ST2, where rough grinding processing for the workpiece W1 is performed. In the rough grinding processing, a grinding surface of the rough grinding stone is pressed against the workpiece W1 with the rough grinding stone and the chuck 3 respectively rotated, to perform rough grinding for the workpiece W1. When a measurement value of the first contact-type thickness measurement device 45 reaches a desired thickness, the rough grinding device 4 finishes the rough grinding by stopping rotating the rough grinding stone and the chuck 3 and causing the rough grinding stone to retreat upward.

Then, the index table 2 rotates, and the chuck 3 moves toward the intermediate grinding stage ST3. In the intermediate grinding stage ST3, intermediate grinding processing for the workpiece W1 is performed. In the intermediate grinding processing, a grinding surface of the intermediate grinding stone is pressed against the workpiece W1 with the intermediate grinding stone and the chuck 3 respectively rotated, to perform intermediate grinding for the workpiece W1. When a measurement value of the second contact-type thickness measurement device 55 reaches a desired thickness, the intermediate grinding device 5 finishes the intermediate grinding by stopping rotating the intermediate grinding stone and the chuck 3 and causing the intermediate grinding stone to retreat upward.

Then, the index table 2 rotates, and the chuck 3 moves toward the fine grinding stage ST4. In the fine grinding stage ST4, fine grinding processing for the workpiece W1 is performed. Specifically, in the fine grinding processing, a grinding surface of the fine grinding stone 61 is pressed against the workpiece W1 with the fine grinding stone 61 and the chuck 3 respectively rotated, to perform fine grinding for the workpiece W1, as illustrated in FIGS. 3(*a*) to 3(*c*). When a measurement value of the non-contact-type thickness measurement device 63 reaches a desired thickness, the fine grinding device 6 finishes the fine grinding by stopping rotating the fine grinding stone 61 and the chuck 3 and causing the fine grinding stone 61 to retreat upward. A measurement value of the non-contact-type thickness measurement device 63 after the fine grinding is set to one obtained by adding a predetermined offset thickness to a final target thickness.

Then, when the index table 2 rotates and the chuck 3 moves toward the platform stage ST1, the film thickness measurement device 7 measures respective film thicknesses of the workpiece W1 at the plurality of measurement points over the entire surface of the workpiece W, as illustrated in FIG. 3(*d*). The number of the measurement points of the film thickness measurement device 7 on the workpiece W1 is set to 200, for example. The film thickness measurement device 7 the measurement points of which are set on the rotational trajectory O of the center axis of the chuck 3 as viewed from the top can measure the film thicknesses of the workpiece W1 without a throughput of grinding processing for the workpiece W1 being reduced while the workpiece W1 that rotates alone around the center axis of the chuck 3 returns to the platform stage ST1.

Then, the control device 8 calculates or determines a shape of the workpiece W1 after the fine grinding processing on the basis of a measurement value of the film thickness measurement device 7. For example, the workpiece W1 illustrated in FIG. 3(*d*) has a center concave shape that is thicker at its peripheral edge than that at its center. The control device 8 calculates a tilt angle of the tilting mechanism such that a difference between a maximum value and a minimum value of the film thickness of the workpiece W1 first processed decreases. A relationship between the shape of the workpiece W1 and the tilt angle of the tilting mechanism is previously set by an experiment or the like.

First Workpiece (Processing in Second Stage)

Then, rough grinding, intermediate grinding, and fine grinding are performed again for the workpiece W1 after the fine grinding.

Specifically, the chuck 3 that holds the workpiece W1 after the fine grinding moves to the rough grinding stage ST2, the intermediate grinding stage ST3, and the fine grinding stage ST4 in this order, like in the above-described processing in the first stage, where rough grinding processing, intermediate grinding processing, and fine grinding processing are performed in this order for the workpiece W1 after the fine grinding.

Figure 4B:
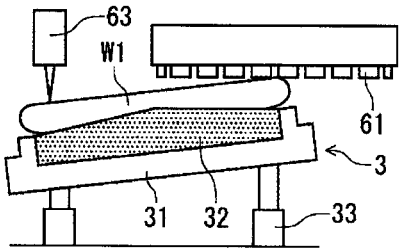
Figure 4C:
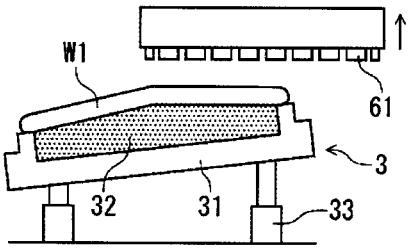
Figure 4D:
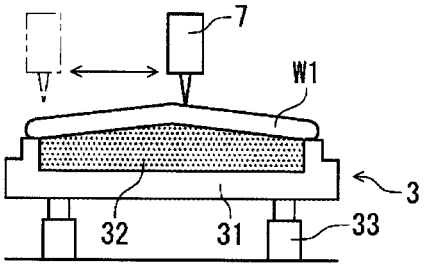

In processing in a second stage for the workpiece W1 after the fine grinding in the rough grinding stage ST2, the intermediate grinding stage ST3, and the fine grinding stage ST4, rough grinding, intermediate grinding, and fine grinding are performed with a rotation axis 3*a* of the chuck 3 tilted by the tilt angle of the tilting mechanism 33 calculated on the basis of a shape of the workpiece W1 after the fine grinding in the first stage, as illustrated in FIGS. 4(*a*) and 4(*b*).

When the measurement value of the non-contact-type thickness measurement device 63 reaches a desired thickness, the fine grinding is finished, as illustrated in FIG. 4(*c*). The measurement value of the non-contact-type thickness measurement device 63 after the fine grinding is set to a final target thickness.

Then, when the index table 2 rotates and the chuck 3 moves toward the platform stage ST1, the film thickness measurement device 7 measures respective film thicknesses of the workpiece W1 at a plurality of measurement points over the entire surface thereof, as illustrated in FIG. 4(*d*).

The control device 8 calculates or determines the shape of the workpiece W1 after the fine grinding on the basis of the measurement values of the film thickness measurement device 7. For example, the workpiece W1 illustrated in FIG. 4(*d*) is formed such that a difference between a maximum thickness and a minimum thickness is smaller and substantially flatter than that in the workpiece W1 after the fine grinding in the first stage. Further, the control device 8 calculates a tilt angle of the tilting mechanism 33 such that a difference between a maximum value and a minimum value of the film thickness of the workpiece W1 after the processing in the second stage decreases.

Thus, when the surface roughness of the fine grinding stone 61 is set to a finer value (about 3 to 4 nm) than a conventional value (about 10 to 13 nm), if the workpiece W1 after the processing in the first stage is subjected to the processing in the second stage using the fine grinding stone 61 like in the conventional technique, the sharpness of the fine grinding stone 61 is poor, and a shape of the workpiece W1 after the processing in the second stage may be unstable or a surface of the workpiece W1 may be burned. However, when the workpiece W1 after the processing in the first stage is subjected to the processing in the second stage by rough grinding, intermediate grinding, and fine grinding in this order, the fine grinding stone 61 is dressed so that the sharpness thereof is maintained, thereby making it possible to stably process the workpiece W1.

In the platform stage ST1, suction-holding between the workpiece W1 and the chuck 3 is released, whereby the workpiece W1 is transferred to the cleaning device from the chuck 3.

Second Workpiece

Then, the second workpiece W2 is suction-held in the same chuck 3 as that in which the first workpiece W1 is suction-held, and rough grinding processing and intermediate grinding processing are performed for the second workpiece W2, like the rough grinding processing and the intermediate grinding processing for the first workpiece W1 described above. In the rough grinding stage ST2 and the intermediate grinding stage ST3, the tilt angle of the rotation axis 3*a* of the chuck 3 is set to substantially the same angle as that when the first workpiece W1 is processed.

Then, the index table 2 rotates, and the chuck 3 moves toward the fine grinding stage ST4. In the fine grinding stage ST4, fine grinding processing for the workpiece W1 is performed.

Figure 5A:
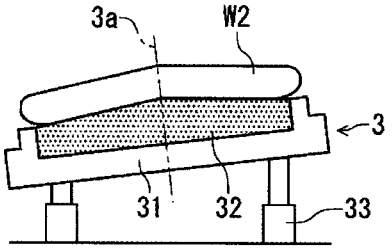
FIGS. 5*a-d* are schematic views illustrating how a second workpiece is processed.
Figure 5B:
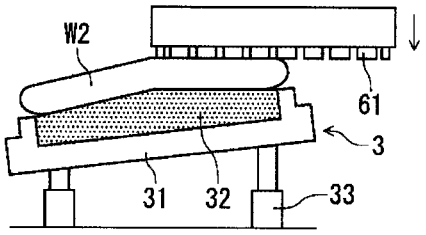
Figure 5C:
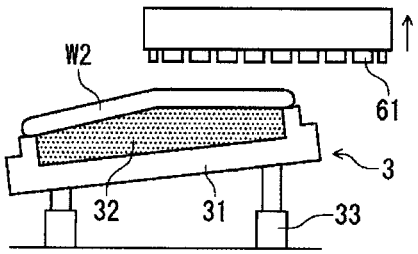
Figure 5D:
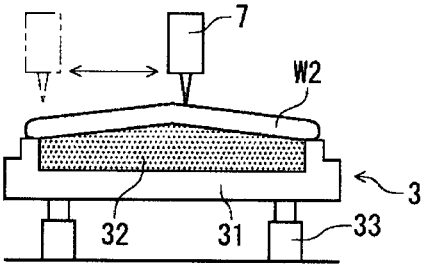

Specifically, as illustrated in FIG. 5(*a*), the rotation axis 3*a* of the chuck 3 is first tilted by the tilt angle of the tilting mechanism 33 calculated on the basis of the shape of the workpiece W1 after the grinding in the second stage. That is, in the rough grinding stage ST2 and the intermediate grinding stage ST3 in which respective approximate shapes of the workpieces W are determined, the workpieces W are processed with the tilt angle of the rotation axis 3*a* of the chuck 3 set to be substantially the same. On the other hand, in the fine grinding stage ST4 in which respective fine shapes of the workpieces W are determined, when the second workpiece W2 is processed, the tilt angle of the rotation axis 3*a* of the chuck 3 is set in consideration of a processing result of the first workpiece W1.

Then, as illustrated in FIG. 5(*b*), the grinding surface of the fine grinding stone 61 is pressed against the workpiece W2 with the fine grinding stone 61 and the chuck 3 respectively rotated, to perform fine grinding for the workpiece W2.

When the measurement value of the non-contact-type thickness measurement device 63 reaches a desired thickness, the fine grinding device 6 finishes the fine grinding by stopping rotating the fine grinding stone 61 and the chuck 3 and causing the fine grinding stone 61 to retreat upward, as illustrated in FIG. 5(*c*).

Thus, the film thickness measurement device 7 rapidly measures a film thickness of the workpiece W1 processed in advance out of the workpieces W1 and W2 to be continuously processed by the same chuck 3, the control device 8 calculates the tilt angle of the rotation axis 3*a* of the chuck 3 capable of processing the workpiece W1 to be substantially flat from the shape of the workpiece W1, the fine grinding device 6 performs fine grinding for the workpiece W2 with the rotation axis 3*a* of the chuck 3 tilted by the tilt angle, thereby making it possible to process the workpiece W2 efficiency and with high accuracy in consideration of a processing result of the workpiece W1.

Further, in the rough grinding stage ST2 and the intermediate grinding stage ST3 in which respective approximate shapes of workpieces W are determined, all the workpieces W are respectively processed under similar conditions. In the fine grinding stage ST4 in which respective fine shapes of the workpieces W are determined, the shape of the workpiece W processed in advance is considered, to perform fine grinding for the workpiece W to be processed thereafter in a tilted state, thereby making it possible to stably process the plurality of workpieces W with high accuracy.

Then, when the index table 2 rotates and the chuck 3 moves toward the platform stage ST1, the film thickness measurement device 7 measures respective film thicknesses of the workpiece W2 at a plurality of measurement points over the entire surface of the workpiece W2, as illustrated in FIG. 5(*d*). The number of the measurement points of the film thickness measurement device 7 on the workpiece W2 is set to 200, for example.

The control device 8 calculates or determines a shape of the workpiece W2 after fine grinding processing on the basis of the measurement value of the film thickness measurement device 7. For example, the workpiece W2 illustrated in FIG. 5(*d*) is formed such that a difference between a maximum thickness and a minimum thickness is smaller and substantially flatter that that in the workpiece W1.

Like for each of third and subsequent workpieces W, a tilt angle of the rotation axis 3*a* of the chuck 3 is calculated such that a difference between a maximum thickness and a minimum thickness of the workpiece W most recently processed by the same chuck 3 decreases on the basis of a shape of the workpiece W most recently processed, and the immediately subsequent workpiece W is ground with the rotation axis 3*a* of the chuck 3 tilted by the tilt angle.

Thus, the processing system 1 according to the present invention is the processing system 1 that processes a workpiece W by rough grinding, intermediate grinding, and fine grinding in this order, the processing system 1 being configured to include the tilting mechanism or device 33 capable of tilting the rotation axis 3*a* of the chuck 3 that holds the workpiece W, the film thickness measurement device 7 that measures a film thickness of the workpiece W after the fine grinding in a non-contact manner, and the control device 8 that calculates or determines a shape of the workpiece W after the fine grinding on the basis of a measurement value of the film thickness measurement device 7, calculates a tilt angle of the tilting device such that a difference between a maximum thickness and a minimum thickness of the workpiece W after the fine grinding decreases, and tilts the chuck 3 by the tilting angle and such that the workpiece W after the fine grinding is reprocessed by rough grinding, intermediate grinding, and fine grinding in this order with the chuck 3 tilted by the tilt angle.

According to this configuration, the film thickness measurement device 7 rapidly measures a film thickness of a workpiece W1 that has been subjected to processing in a first stage, and the control device 8 calculates a tilt angle of the rotation axis 3*a* of the chuck 3 capable of processing the workpiece W1 to be substantially flat from a shape of the workpiece W1 and performs rough grinding, intermediate grinding, and fine grinding again for the workpiece W1 with the rotation axis 3*a* of the chuck 3 tilted by the tilt angle. Accordingly, even when a grinding stone of the fine grinding device 6 is fine, the sharpness of the fine grinding stone 61 is maintained through the rough grinding and the intermediate grinding, thereby making it possible to process the workpiece W1 efficiently and with high accuracy.

Further, when the same workpiece W1 is subjected to processing in two stages, thermal expansion and thermal shrinkage of the chuck 3 or the like with processing heat at the time of grinding may not be converged at the time of film thickness measurement in the first stage, while thermal expansion and thermal shrinkage of the chuck 3 or the like with processing heat at the time of grinding are converged at the time of film thickness measurement in the second stage, thereby making it possible to operate the shape of the workpiece W1 with high accuracy.

The processing system 1 according to the present invention further includes the index table 2 that rotates and moves the chuck 3 on the trajectory O. The film thickness measurement device 7 is configured to be installed on the trajectory O as viewed from the top.

According to this configuration, measurement points of the film thickness measurement device 7 are set on the trajectory O of the index table 2 as viewed from the top, thereby making it possible to measure a film thickness of the workpiece W without a throughput of grinding processing for the workpiece W being reduced.

It should be understood that various modifications can be made in addition to the foregoing without departing from the spirit of the prevent invention and the present invention covers the modifications.

REFERENCE SIGNS LIST

1: processing system
2: index table
2*a*: rotation axis (of index table)
3: chuck
3*a*: rotation axis of (chuck)
31: rotation table
32: suction member
4: rough grinding device
41: first spindle
42: first spindle feeding mechanism
43: linear guide (of rough grinding device)
44: ball screw slider mechanism (of rough grinding device)
45: first contact-type thickness measurement device
46, 47: detection arm
5: intermediate grinding device
51: second spindle
52: second spindle feeding mechanism
53: linear guide (of intermediate grinding device)
54: ball screw slider mechanism (of intermediate grinding device)
55: second contact-type thickness measurement device
56, 57: detection arm
6: fine grinding device
61: fine grinding stone
62: third spindle
63: non-contact-type thickness measurement device
7: film thickness measurement device
8: control device
ST1: platform stage
ST2: rough grinding stage
ST3: intermediate grinding stage
ST4: fine grinding stage
W, W1, W2: workpiece

What is claimed is:

1. A processing system that processes a workpiece by pre-grinding and fine grinding in this order, the processing system comprising:

a tilting device capable of tilting a rotation axis of a chuck that holds the workpiece;

a measurement device that measures film thicknesses of a fine-ground workpiece at a plurality of measurement points in a non-contact manner; and a control device that calculates a shape of the fine-ground workpiece on the basis of a measurement value of the measurement device, calculates a tilt angle of the tilting device such that a difference between a maximum thickness and a minimum thickness of the fine-ground workpiece decreases, and tilts the chuck by the tilt angle, wherein the fine-ground workpiece is reprocessed by pre-grinding and fine grinding in this order with the chuck tilted by the tilt angle.

2. The processing system according to claim 1, further comprising:

an index table that rotates and moves the chuck on a predetermined trajectory, wherein the measurement device is installed on the trajectory as viewed from the top.

* * * * *